US006518490B2

(12) United States Patent
Good

(10) Patent No.: US 6,518,490 B2
(45) Date of Patent: Feb. 11, 2003

(54) DRUM HEAD WITH SOUND ATTENUATING CENTER COATING

(75) Inventor: John J. Good, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 09/766,931

(22) Filed: Jan. 23, 2001

(65) Prior Publication Data

US 2002/0096035 A1 Jul. 25, 2002

(51) Int. Cl.[7] ..... G10D 13/02
(52) U.S. Cl. ..... 84/414; 84/411 R
(58) Field of Search ..... 84/414, 411 R, 84/413, 412, 421, 411 M, 411 A

(56) References Cited

U.S. PATENT DOCUMENTS

| | | | | |
|---|---|---|---|---|
| 3,250,169 A | | 5/1966 | Stone, Jr. et al. | |
| 4,018,944 A | | 4/1977 | Hallstrom et al. | |
| 4,244,266 A | | 1/1981 | Hardy | |
| 4,254,685 A | | 3/1981 | Rose | |
| 4,282,793 A | | 8/1981 | Muchnick | |
| 4,308,782 A | | 1/1982 | Hartry | |
| 4,325,280 A | | 4/1982 | Hardy | |
| 4,899,635 A | | 2/1990 | Santangelo | |
| 5,091,248 A | | 2/1992 | Belli | |
| 5,377,576 A | | 1/1995 | Good et al. | |
| 5,864,077 A | * | 1/1999 | Gatzen | 84/411 M |
| 5,920,021 A | | 7/1999 | Good | |
| 6,184,451 B1 | * | 2/2001 | Miller et al. | 84/411 R |

FOREIGN PATENT DOCUMENTS

WO PCT/US80/01185 12/1981

OTHER PUBLICATIONS

Materials Science and Engineering p. 375 to Smith

* cited by examiner

*Primary Examiner*—Kim Lockett
(74) *Attorney, Agent, or Firm*—William W. Haefliger

(57) ABSTRACT

A sound attenuating drum head that has a support ring, a synthetic membrane carried by the ring, a localized thin coating on the membrane, and acting to attenuate vibration of the head, when struck, that coating confined on a mid-region of the head.

11 Claims, 4 Drawing Sheets

10
20
32
33
62
60
36a
34
34a
14
11a
12a
12
11
36
25
47
25
47
11c
46
11d
15
13a
11b
13
45
46a
21
43
44
60a

DRUM HEAD WITH SOUND ATTENUATING CENTER COATING

BACKGROUND OF THE INVENTION

This invention relates generally to drumming apparatus, and more particularly to an apparatus associated with a drum, such as a tom-tom, for sound attenuating a drum head with desired acoustic effects.

There is need for improved, simple, effective means to achieve desired drum sound effects, such as sound attenuation, when the drum head is struck with a beater, such as a drum stick. This invention improves over the invention of my U.S. Pat. No. 5,920,021.

SUMMARY OF THE INVENTION

It is a major object of the invention to provide improved apparatus meeting the above needs. Basically, the improved apparatus or device of the invention comprises:

a) a support ring, b) a synthetic membrane carried by the ring, and having a mid region and an outer annular region extending about the mid region, c) a thin coating confined on the membrane over the mid region, and acting to attenuate vibration of the head, when struck.

Another object includes the provision of abrasive particles in said coating, the coating confined radially inwardly of the outer annular region, which is free of coating material.

A further object includes provision of a drum casing or shell supporting the membrane, spaced outwardly of the annularly extending coating. The shell is typically annular and has an edge annularly engaging the membrane at one side thereof, the coating located at the opposite side of the membrane, and being everywhere spaced form that edge so as not to abrade.

Yet another object includes provision of flange structure transmitting clamping loading to the opposite side of the membrane, at the periphery thereof, to tension the membrane.

It is found that the provision of such a thin coating on the drum head, attached to a drum, serves to directly attenuate or muffle the sharp, metallic sound produced by the drum when the head is struck by a drum stick, as for example on the coating itself.

These and other objects and advantages of the invention, as well as the details of an illustrative embodiment, will be more fully understood from the following specification and drawings, in which:

DRAWING DESCRIPTION

DETAILED DESCRIPTION

Figure 1:
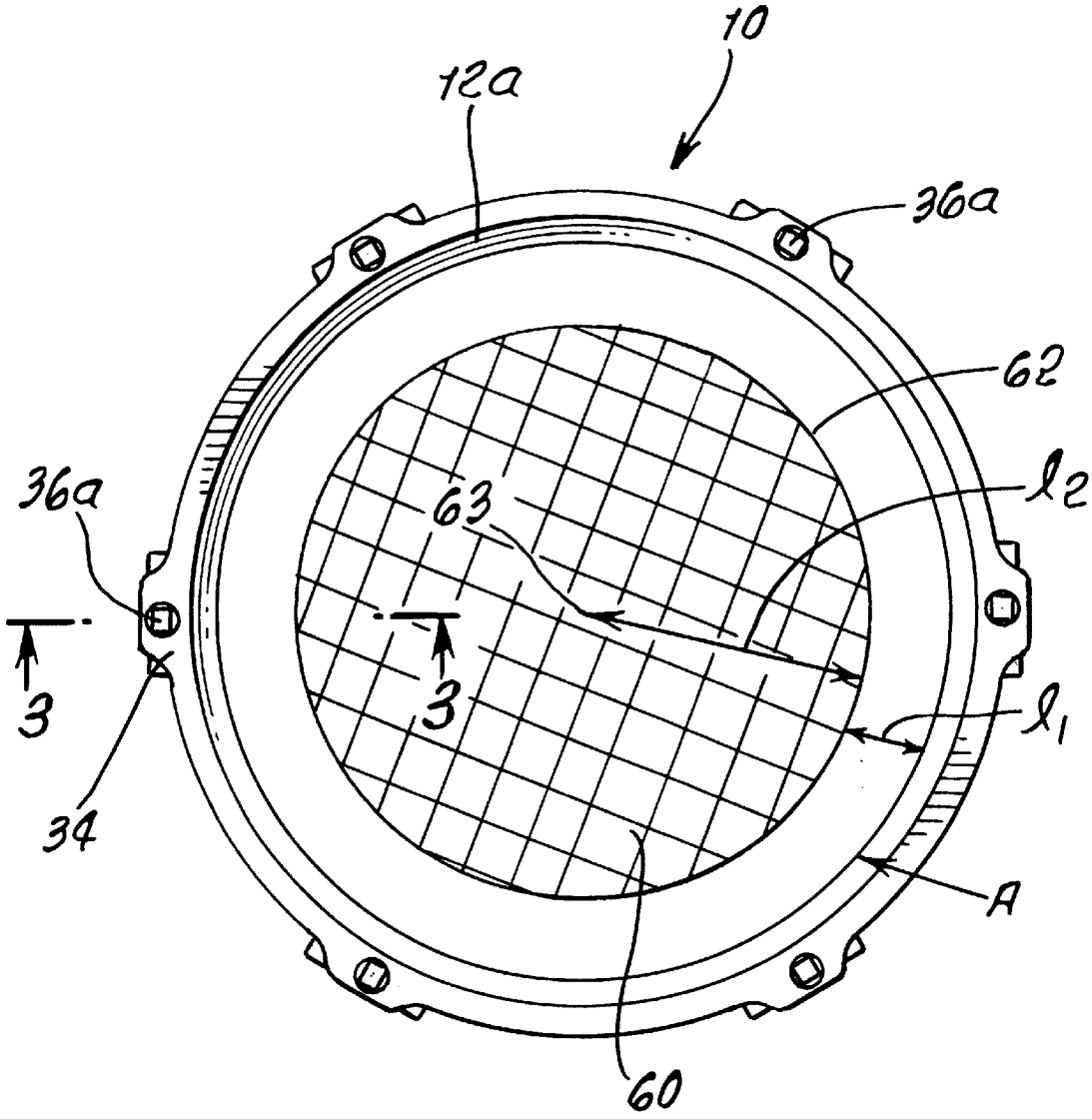
FIG. 1 is a top plan view of a drum head, incorporating the invention.

In the drawings, a drum 10 has a shell 11 comprising a cylindrical section or sections located in axially extending position. Drum 10 may be a tom-tom.

Figure 3:
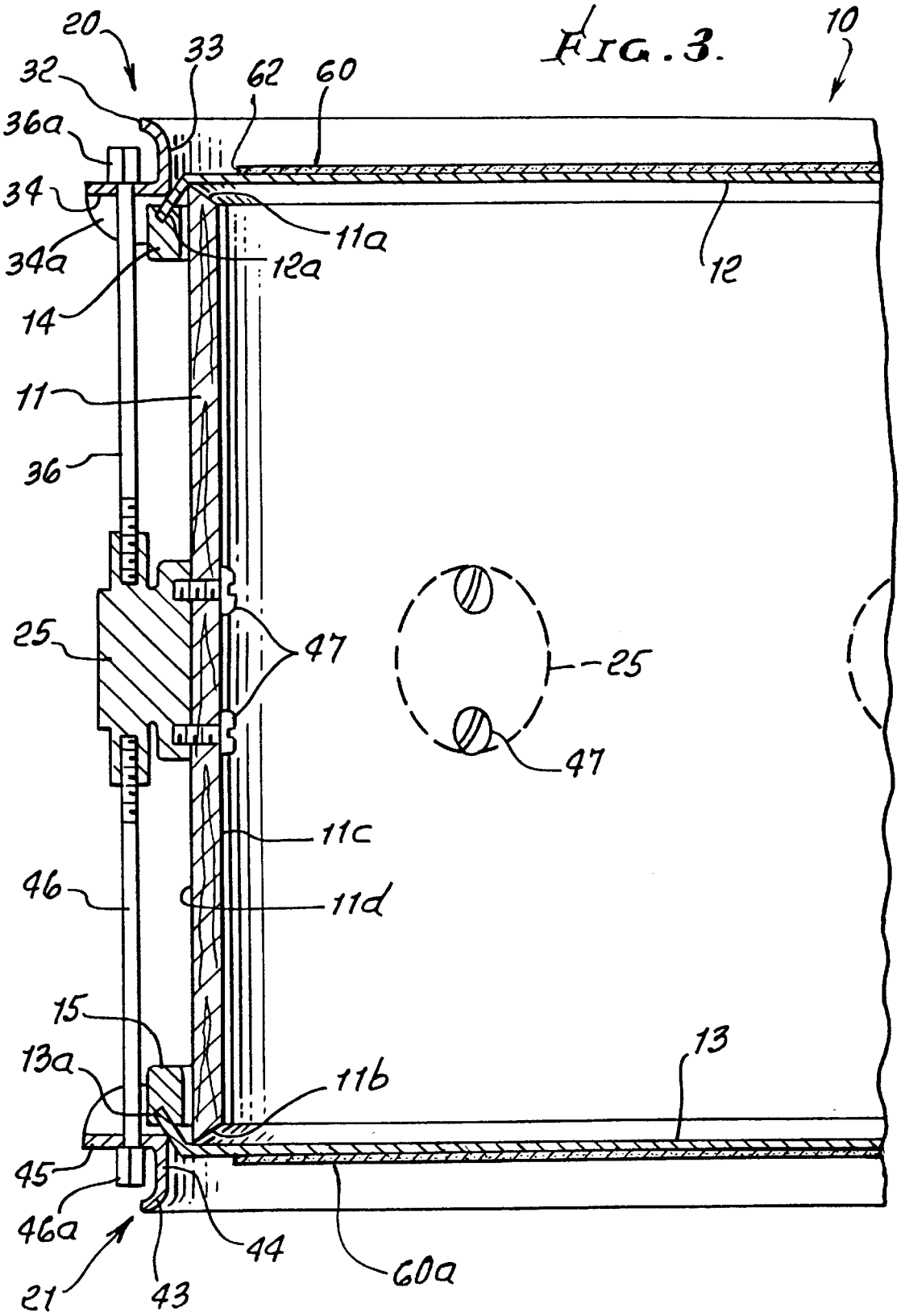
FIG. 3 is an enlarged vertical section taken on lines 3—3 of FIG. 1.

Opposite annular and inwardly angled ends of the shell appear at 11*a* and 11*b* in FIG. 3. The shell typically consists of wood and has inner and outer cylindrical walls 11*c* and 11*d*.

Drum heads 12 and 13 extend over the shell ends 11*a* and 11*b* and are retained in taut condition. They may consist of thin sheets of synthetic, resinous plastic or other material (one example being MYLAR) that produces a sharp sound when struck, and needing attenuation. Annular metallic flanges or rings 14 and 15 typically attached to the angled edge extents 12*a* and 13*a* of the respective heads 12 and 13 for retaining them in taut condition. Flanges 14 and 15 extend about opposite end extents of the shell, as seen in FIG. 3.

The retainer structure shown includes flange structure 20 provided in association with one end 11*a* of the shell, and flange structure 21 in association with the other end 11*b* of the shell.

Figure 2:
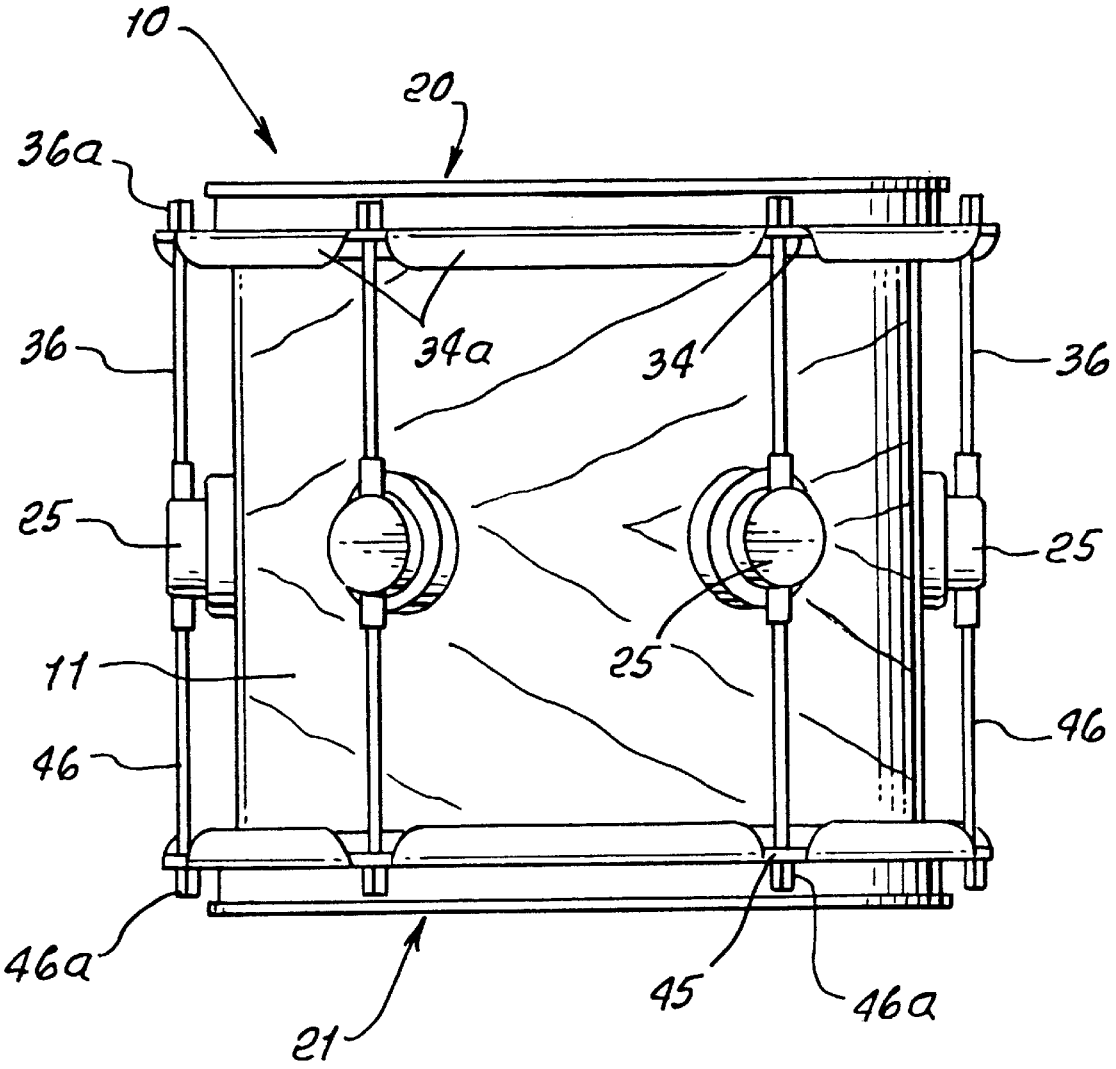
FIG. 2 is a side elevational view of the FIG. 1 drum incorporating the invention.

In one drum example, the upper flange structure 20 has an upwardly extending annular rim portion 32 extending above the level of drum head 12, a medial annular portion 33 extending radially outwardly below the level of 32, for transmitting head tightening loading to flange 14, and a lower annular extending portion 34 extending radially from the lower extent of 33. That portion has integral downwardly extending ribs 34*a*. A tightening adjustment fastener rod 36 extends downwardly through 33 and has external threads that interfit upper internal threads in holder or stud 25. Note fastener head 36*a* bearing on the upper surface of 34 in FIG. 2. The lower surface of 33 exerts downward loading onto downwardly deflected or angled annular edge portion 12*a* of 12, attached to retention ring or flange 14, for adjusting the tautness of head 12, by drawing the head over the upper edge of 11*a*.

Likewise, lower flange structure 21 has a downwardly extending annular rim portion 43 extending below the level of drum head 13, a medial annular portion 44 extending radially outwardly above the level of 43 for transmitting head tightening loading, and an upper annularly extending portion 45 extending radially from upper extent of 44. See upwardly angled edge portion 13*a* 13, attached to ring 15. A tightening adjusting fastener rod 46 extends upwardly through 44 and has external threads that interfit rotatably lower internal threads in holder or stud 25. Note fastener head 46*a* bearing upwardly on the lower surface of 44. The upper surface of 44 exerts upward loading onto head edge portion 13*a*, attached to lower retention ring or flange 15, for adjusting tautness of head 13, i.e., over lower edge of bevel 11*b*. Fasteners connect 25 to 11 at 47. Accordingly, the drum heads are individually adjustable, while the drum heads are stretched over metal edges, with acoustic benefits; however, it is sometimes desirable to provide for attenuation or softening of the sharp, metallic sound created by beater stick impact on the drum head.

In accordance with an important aspect of the invention, sound attenuating structure is provided in direct association with one and/or both of the heads 12 and 13. Such structure is in the form of a thin coating, as for example at 60, extending on the membrane and over its mid-region on at least one head, and acting to attenuate vibration of the head, when struck as by a drum stick. It is found that when a drum stick directly strikes the mid-region coating, a highly muffled sound is created, as is at times desirable. Typically, the coating may consist of a carrier, and abrasive particles in the carrier, which is bonded to the head. In one example, the head may comprise a membrane consisting of synthetic, resinous material, such as MYLAR.

The carrier may consist of solvent base material, or epoxy resin; and the abrasive particles filled into the carrier consist of fillers, or of glass frit.

The coating is shown as forming radially inwardly of an annular band, free of coating, confined in annular zone A of radial length $l_1$, within the outermost 40% of the head overall radius. Thus, radial length $l_2$, as measured from the head center 63, subtends 60% of the overall radius and lies radially inwardly of the inner edge 62 of that band. This assures that at least 40% of the head overall radius, and outwardly of the coating, is substantially uncoated; that uncoated region extending to edge portion 13*a* at shell angled end 11*a*, whereby the coating 60 is spaced from 11*a* and is not abraded as by bending.

The thickness of the preferred head mid-region, disc shaped coating is within the range 3 mm to 3.2 mm inches; and the radial overall dimension of the uncoated band is preferably within the range 0.5 and 1.0 inches.

A similar or like coating region 60*a* is or may be applied to the opposite end head 13, which is like head 12, whereby both heads are substantially alike.

Figure 4:
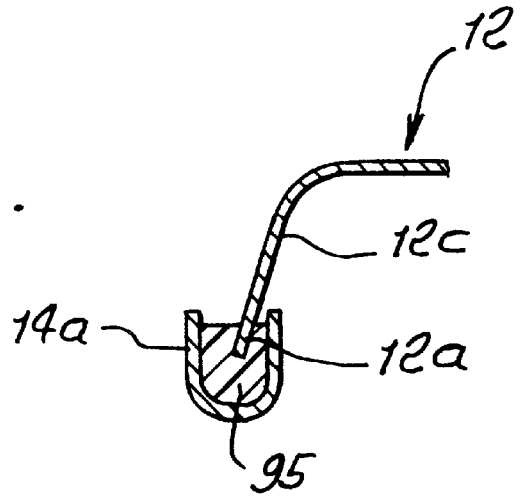
FIG. 4 is an enlarged section showing alternative support for the drum head.

FIG. 4 shows an alternative ring support at 14*a* for the edge of the membrane 12. Support ring 14*a* is metallic and is channel shaped, as shown. The edge 12*a* of the turned or angled annular portion 12*c* of head 12 is received in the channel and bonded to the channel, as by hardened bonding material 95 in the channel, epoxy being one example.

Figure 5:
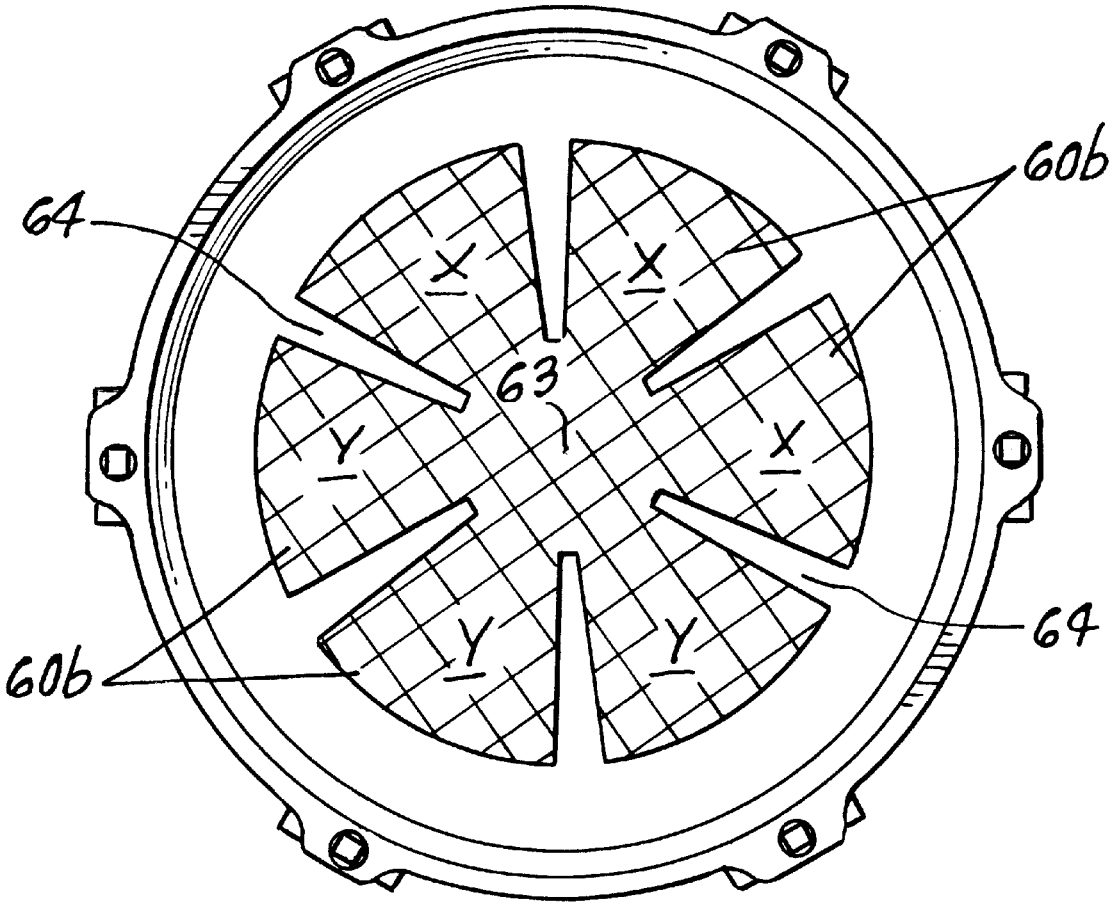
FIG. 5 is a view like FIG. 1 showing a modification.

FIG. 5 shows a head on which the sound attenuating coating material is discontinuous, i.e., is in segments 60*b*, spaced apart at 64 about the center 63 of the head. The thickness of certain coating segments may vary for varied muffling effect, depending upon which head coated segments are struck by drumsticks. For example, segments designated at X may have substantially greater coating thickness (double or triple thickness as one possibility) than segments designated at Y. Such indicia may be formed or applied to the segmented coatings, to enable the drummer to easily apply drumsticks to the selected muffling coating or coatings.

I claim:

1. A sound attenuating drum head, the combination comprising:

a) a support ring, b) a membrane carried by the ring, and having a mid-region and an outer annular region extending about the mid-region, c) a thin coating confined on the membrane over the mid-region, and acting to attenuate vibration of the head, when struck, d) the coating having an outer edge curving about said mid-region, the entirety of said outer edge lying inwardly of 20% of the head radius as measured toward the center of the head and from an outer edge of the head, whereby the entirety of said outer annular region is free of said coating, e) the coating consisting of epoxy resin bonded to the membrane, and containing abrasive filler particles, f) the coating upstanding from the membrane.

2. The combination of claim 1 including a drum shell supporting said membrane.

3. The combination of claim 2 wherein said shell is annular and has an edge annularly engaging the membrane at the inside thereof, said coating located at the opposite side of the membrane.

4. The combination of claim 3 including flange structure transmitting clamping loading to said opposite side of the membrane, at the periphery thereof, to tension the membrane.

5. The combination of claim 3 wherein said coating is everywhere spaced radially inwardly from said edge.

6. The combination of claim 1 wherein the coating is in the form of a disc adherent to the head, said disc containing particulate material.

7. The combination of claim 1 including a second drum head membrane carried by the shell, and a second sound attenuating coating on the second membrane.

8. The combination of claim 1 wherein the coating extends in segments spaced apart about the center of the drum.

9. The combination of claim 1 wherein the coating has thickness within the range 3 mm to 3.2 mm.

10. The combination of claim 1 wherein different portions of the coating have different thicknesses.

11. The combination of claim 8 wherein the coatings on different segments have different thicknesses.

* * * * *